US006699543B1

(12) United States Patent
Agarwal

(10) Patent No.: US 6,699,543 B1
(45) Date of Patent: Mar. 2, 2004

(54) POLYPROPYLENE ULTRA-LIGHTWEIGHT FOOD CONTAINERS

(75) Inventor: Surendra H. Agarwal, Glenview, IL (US)

(73) Assignee: Kraft Foods Holdings, Inc., Northfield, IL (US)

( * ) Notice: Subject to any disclaimer, the term of this patent is extended or adjusted under 35 U.S.C. 154(b) by 0 days.

(21) Appl. No.: 09/596,918

(22) Filed: Jun. 20, 2000

(51) Int. Cl.[7] ..... B29D 22/00

(52) U.S. Cl. ..... 428/35.7; 428/36.92; 428/213; 428/216

(58) Field of Search ..... 428/35.7, 36.92, 428/216, 213

(56) References Cited

U.S. PATENT DOCUMENTS 3,514,501 A * 5/1970 Leibson et al. ..... 260/878
5,258,464 A * 11/1993 McCullough et al. ..... 525/244
5,502,112 A * 3/1996 Peacock ..... 525/240
5,935,505 A * 8/1999 Whetten et al. ..... 264/328.1
6,211,500 B1 * 4/2001 Cochran et al. ..... 219/725

* cited by examiner

*Primary Examiner*—Sandra M. Nolan
(74) *Attorney, Agent, or Firm*—Fitch, Even, Tabin & Flannery

(57) ABSTRACT

Polypropylene ultra-lightweight food containers are provided which have good impact resistance at low temperatures. Such polypropylene ultra-lightweight containers can be used for packaging refrigerated or frozen food products. The use of polypropylene to prepare such containers allows for significant reduction in the thickness of container components without significant reduction in impact strength. The polypropylene ultra-lightweight containers of the present invention are prepared by injection molding. The polypropylene useful in preparing the food containers of this invention contains about 15 to about 25 molar percent polyethylene and has a melt flow index of about 30 to about 50 g/10 min. Weight reductions of about 20 to 40 percent can be obtained without significantly reducing impact resistance as compared to conventional polyethylene containers.

15 Claims, 1 Drawing Sheet

POLYPROPYLENE ULTRA-LIGHTWEIGHT FOOD CONTAINERS

FIELD OF THE INVENTION

This invention relates to polypropylene ultra-lightweight containers. More specifically, this invention relates to polypropylene ultra-lightweight containers that can be used for packaging refrigerated or frozen food products. The use of polypropylene having relatively high levels of polyethylene to prepare such containers allows for significant reduction in the thickness of container components without significant reduction in impact strength.

BACKGROUND OF THE INVENTION

Containers for retail food products must meet a number of requirements. First, they must not significantly modify taste, odor, texture, or other organoleptic properties of the food product stored therein. They must also be able to consistently survive shipping and/or handling from the manufacturer to the retail outlet as well as display at the retail outlet and transportation from the retail outlet to the home. Thus, such containers must have significant impact resistance. For frozen or refrigerated food products, significant impact resistance must be maintained at low temperatures. In many cases, the container (or at least certain components such as, for example, the lid) must also remain flexible at such low temperature.

Typically, such food containers and lids are prepared from high density polyethylene (HDPE), low density polyethylene (LDPE), or high flow linear low density polyethylene (LLDPE). Polypropylenes having relatively low levels of polyethylene (i.e., generally below about 12 molar percent) have also been used to prepare food containers (bowls only) which can be used at refrigeration temperatures (i.e., about 35 to about 40° F.); polypropylene has generally not been used successfully to prepare corresponding lids. Although such materials posses reasonable properties, relatively thick walls (and, thus, relatively high weights) are generally required to obtain containers having the required flexibility, impact resistance, and the like. Moreover, it is difficult to prepare thin-wall containers using these polyethylenes and polypropylenes with injection molding techniques to provide good impact strength at freezer temperatures (below 0° F.); moreover, polypropylenes do not provide good impact strength at freezer temperatures (below 0° F.). Generally, such polyethylenes and polypropylenes will not consistently fill the injection molds if wall thickness is below about 0.024 inches.

It would be desirable, therefore, to provide food containers having significantly reduced wall thicknesses and, thus, overall weight, without significantly reducing impact resistance. It would also be desirable to provide such reduced wall thickness containers which maintain their impact resistance at frozen and/or refrigeration temperatures. The present invention provides such food containers. By reducing the wall thickness, significant cost savings can be achieved.

SUMMARY OF THE INVENTION

This invention relates to polypropylene ultra-lightweight containers. More specifically, this invention relates to polypropylene ultra-lightweight containers that can be used for packaging refrigerated or frozen food products. The use of polypropylene to prepare such containers allows for significant reduction in the thickness of container components without significant reduction in impact strength. The polypropylene ultra-light containers of this invention are especially preferred for use with refrigerated or frozen food products. For example, the present food containers (generally consisting of a lid and a bowl) can be used to package Cool Whip™ and similar food products which will be sold and stored at refrigeration or frozen temperatures.

The polypropylene ultra-lightweight containers of the present invention are prepared by injection molding, preferably using injection molds with multiple gates (i.e., multiple inlets for the injected polypropylene). Initially it was thought that such multiple gate molds would be necessary to allow-the mold to completely fill. It has surprisingly been found that such multiple gate molds are not required. Thus, a single gate mold (wherein the gate is generally located at the bottom of the bowl mold and at the center of the lid mold) can be used. The ability to use such single gate molds is a significant advantage since multiple gate molds are more costly and complex to make and use. The polypropylene useful in this invention contains about 15 to about 25 molar percent polyethylene and has a melt flow index of about 30 to about 50 g/10 min. (ASTM 1238). More preferably, the polypropylene useful in this invention contains a relatively high amount of polyethylene (i.e., about 17 to about 19 molar percent) and has a melt flow index of about 30 to about 40 g/10 min (ASTM 1238). An especially preferred polypropylene for use in the present invention is a polypropylene copolymer resin sold under the tradename Pro-fax™ SG-802N by Montell North America Inc. and having about 17.7 molar percent polyethylene, about 11 weight percent ethylene, and a melt flow index of about 35 g/10 min (ASTM 1238). This particular polypropylene from Montell North America has been used mainly for automotive interior trim and seating.

The use of polypropylene as described herein allows the production of bowls and lids having significantly reduced wall thicknesses (generally less than about 0.018 inches thick) and reduced overall weights without sacrificing impact resistance, especially at low temperatures (i.e., about −10 to about 40° F.). Moreover, the use of the present polypropylene allows the production of thin-walled bowls and lids using injection molding techniques.

Using such polypropylenes to prepare, for example, lids and bowls similar to those used for packaging Cool Whip™, allows for weight reductions and wall-thickness reductions of about 20 to 40 percent without significantly reducing impact resistance as compared to conventional polyethylene containers. Such thin-walled polypropylene containers maintain sufficient impact resistance and flexibility at low temperatures (i.e., about −10° F.) to allow their use for refrigerated and/or frozen food products.

DETAILED DESCRIPTION OF PREFERRED EMBODIMENTS

Figure 1:
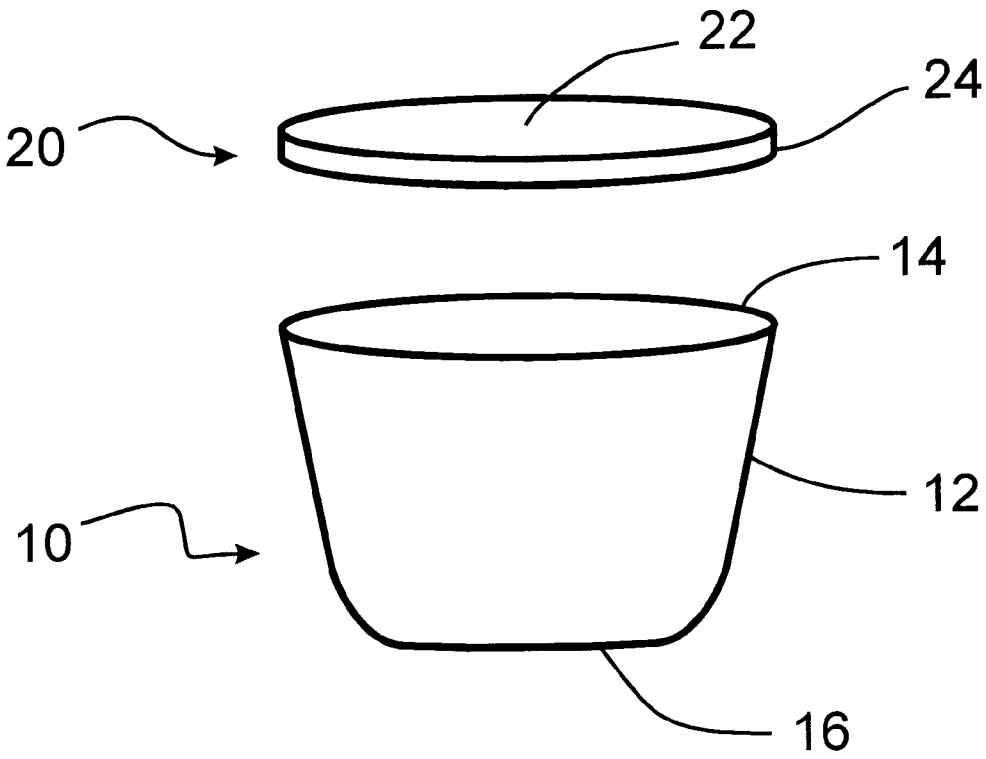
FIG. 1 illustrates the bowl and lid of the present invention.

The present invention provides ultra-lightweight food containers with good low temperature properties prepared by injection molding using polypropylene having about 15 to about 25 molar percent polyethylene and a melt index of about 30 to about 50 g/10 min (ASTM 1238). The polypropylene ultra-lightweight containers are prepared by injection molding, preferably using unit cavity injection molds with multiple gates (i.e., multiple inlets for the injected polypropylene). More preferably, the polypropylene useful in this invention contains a relatively high amount of polyethylene (i.e., about 17 to about 19 molar percent) and has a melt flow index of about 30 to about 40 g/10 min (ASTM 1238). An especially preferred polypropylene for use in the present invention is a polypropylene copolymer resin sold under the tradename Pro-fax™ SG-802N by Montell North America Inc. and having about 17.7 molar percent polyethylene, about 11 weight percent ethylene, and a melt flow index of about 35 g/10 min (ASTM 1238). This particular polypropylene from Montell North America has been used mainly for automotive interior trim and seating.

The polypropylene containers of this invention have significantly reduced wall thicknesses (generally less than about 0.018 inches thick) and reduced overall weights without sacrificing impact resistance, especially at low temperatures (i.e., about −10 to about 40° F.). For example, lids and bowls similar to those used for packaging Cool Whip™ and prepared using the polypropylene of the present invention, allow for weight reductions and wall-thickness reductions of about 20 to 40 percent without significantly reducing impact resistance as compared to conventional polyethylene containers. Such thin-walled polypropylene bowls and lids maintain sufficient impact resistance and flexibility at low temperatures (i.e., about −10° F.) to allow their use for refrigerated and/or frozen food products.

Ultra-lightweight polypropylene food containers of the present invention comprise a bowl and a lid, wherein the bowl has a sidewall, a bottom portion, and a first rim and wherein the lid has a central portion and a second rim, wherein the first rim and the second rim can be mated to form a closed container, wherein the bowl and lid are prepared by injection molding using a polypropylene having about 15 to about 25 molar percent polyethylene and a melt index of about 30 to about 50 g/10 min (ASTM 1238), wherein the sidewall thickness of the bowl is about 0.016 to about 0.022 inches and the central portion thickness of the lid is about 0.014 to about 0.020 inches, and wherein the bowl and lid each have good impact resistance at −10F. Such lids can also be used as overcaps, especially where refrigeration or freezer storage is likely. Thus, for example, overcaps having central portion thickness of about 0.014 to about 0.020 inches could be used to seal coffee cans or tins (whether plastic or metal) for storage under refrigeration or frozen conditions once the coffee is opened.

Preferably the bowls of the present invention are about 3 to about 8 inches in diameter with a height of about 2 to about 8 inches. Such bowls generally have a sidewall with an upper end and a lower end, a bottom connected to the lower end, and a rim connected to the upper end. The rim is designed to mate with a similar rim on the lid. Generally, the bowls of the present invention have capacities of about 200 to about 2000 cc. The lids of the present invention are generally about 3 to about 8 inches in diameter and have a rim designed to mate with the corresponding rim on the bowl or, in the case of overcaps, with a corresponding rim on the container.

FIG. 1 illustrates one embodiment of the present invention. The single compartment bowl 10 has a sidewall 12 with a bottom portion 16 and a rim 14. The corresponding lid 20 has a central portion 22 and rim 24. Rims 14 and 24 are designed to mate with one another when the lid 20 is placed on the bowl 10 (i.e., forming the closed container). Although the present invention is mainly directed to circular or oval shaped bowls and lids, other shaped bowls and lids can be made using the present invention. Likewise, although the present invention is mainly directed to single compartment bowls, bowls with more than one compartment can also be made using the present invention.

The following examples are intended to illustrate the invention and not to limit it.

EXAMPLE 1

Polypropylene SG−820N from Montell North America Inc. was used to prepare 12 oz. bowls (single compartment) having a thickness of about 0.018 inches as measured in the sidewall. Bowls were prepared by injection molding using both (1) a unit cavity mold with four rim-gates and (2) a unit cavity mold with a single gate located at the bottom of the mold). Initially it was though that the multiple gates would be required to obtain good flow. Surprisingly, the mold with the single gate worked as well as the multiple gate mold using polypropylene; thus, more complex and costly multiple gate molds are not required.

For comparison purposes, conventional HDPE bowls (wall thickness of about 0.024 inches) were also prepared. (Attempts to prepare thin-wall polyethylene bowls failed since the polyethylene would not fill the mold at normal operating conditions; increased flow could be obtained at higher temperature but significant polymer degradation was observed.) The injection molding process with the polypropylene bowls, in spite of the reduced wall thickness, ran essentially as the control process with normal wall thickness. Weight reductions of about 27 percent (i.e., about 22 g/bowl for polypropylene bowls versus about 31 g/bowl for the control bowls) was obtained. In cold drop impact tests at −10° F., the ultra-lightweight bowls gave zero breakage as compared to over 5 percent breakage for the control bowls.

EXAMPLE 2

Lids for the bowls described in Example 1 were prepared by injection molding techniques using polypropylene (SG−820N from Montell North America Inc.) and high flow linear low density polyethylene (control). Attempts to prepare ultra-lightweight lids (i.e., wall thickness of about 0.020 inches or less) using the polyethylene failed; the polyethylene could not fill the entire mold. A unit mold cavity with a single gate located at the center of the lid was used. The following results were obtained:

| | | Control LLDPE | Ultra-Lightweight PP | Reduction (%) |
|---|---|---|---|---|
| Weight (g) | | 14.43 | 8.46 | 41 |
| Thickness (in.) | Inside | 0.023 | 0.016 | 30 |
| | Outside Rim | 0.024 | 0.017 | 29 |
| Rim Height (in.) | | 0.302 | 0.262 | 13 |

Rims were then placed on filled bowls (essentially as prepared in Example 1; bowls filled with Cool Whip™) and then placed in boxed cases of 24 (4 tiers with 6 bowls per tier) and stored at −10° F. for 24 hours. The boxes were then dropped from a height of about 24 inches onto a concrete surface; the boxes were dropped onto each of the six sides. The control lids shown no damage. Approximately 5 percent of the polypropylene exhibited minor cracking. Only polypropylene lids on the bottom tier, however, were damaged. Thus, failure was apparently due to compression due to the upper layers of bowl/lid combinations. Rounding the outside edges of the lids should avoid this problem; reducing the angle of the rim step down from about 90° to about 45° should be sufficient.

EXAMPLE 3

Using bowl and lid combinations as prepared in Examples 1 and 2, the polypropylene containers were filed with fat-free Cool Whip™ and stored at −5° F. for 21 days. The fat-free product was used since it is more sensitive to off-flavors than the full-fat product. No odors, off-flavors, or other defects were found in the product after the 21 day test. Further tests indicate that no odors, off-flavors, or other defects develop over the shelf life of the product (i.e., about 18 months).

I claim:

1. An ultra-lightweight polypropylene food container comprising a bowl and a lid, wherein the bowl has a sidewall, a bottom portion, and a first rim and wherein the lid has a central portion and a second rim, wherein the first rim and the second rim can be mated to form a closed container, wherein the bowl and lid are prepared by injection molding using a polypropylene having about 15 to about 25 molar percent polyethylene and a melt index of about 30 to about 50 g/10 min, wherein the sidewall thickness of the bowl is less than about 0.022 inches and the central portion thickness of the lid is less than about 0.022 inches, and wherein the bowl and lid each have sufficient impact resistance at −10F. to allow use for refrigerated and/or frozen food product.

2. The ultra-lightweight polypropylene food container of claim 1, wherein the polypropylene contains about 17 to about 19 molar percent polyethylene and has a melt index of about 30 to about 40 g/10 min., wherein the sidewall thickness of the bowl is about 0.016 to about 0.022 inches, and wherein the central portion thickness of the lid is about 0.014 to about 0.020 inches.

3. The ultra-lightweight polypropylene food container of claim 2, wherein the polypropylene contains about 17.7 molar percent polyethylene has a melt index of about 35 g/10 min., wherein the sidewall thickness of the bowl is about 0.016 to about 0.022 inches, and wherein the central portion thickness of the lid is about 0.014 to about 0.020 inches.

4. An ultra-lightweight polypropylene bowl suitable for food products, wherein the bowl has a sidewall with an upper end and a lower end, a bottom portion connected to the lower end, and a rim connected to the upper end, wherein the rim is adapted to mate with a lid to form a closed container, wherein the bowl is prepared by injection molding using a polypropylene having about 15 to about 25 molar percent polyethylene and a melt index of about 30 to about 50 g/10 min, wherein the sidewall thickness of the bowl is less than about 0.022 inches, and wherein the bowl has sufficient impact resistance at −10F. to allow use for refrigerated and/or frozen food product.

5. The ultra-lightweight polypropylene bowl of claim 4, wherein the polypropylene contains about 17 to about 19 molar percent polyethylene and has a melt index of about 30 to about 40 g/10 min. and wherein the sidewall thickness of the bowl is about 0.016 to about 0.022 inches.

6. The ultra-lightweight polypropylene bowl of claim 5, wherein the polypropylene contains about 17.7 molar percent polyethylene has a melt index of about 35 g/10 min. and wherein the sidewall thickness of the bowl is about 0.016 to about 0.022 inches.

7. The ultra-lightweight polypropylene bowl of claim 4, wherein the bowl is prepared by injection molding using a unit cavity mold with a single gate.

8. The ultra-lightweight polypropylene bowl of claim 5, wherein the bowl is prepared by injection molding using a unit cavity mold with a single gate.

9. The ultra-lightweight polypropylene bowl of claim 6, wherein the bowl is prepared by injection molding using a unit cavity mold with a single gate.

10. An ultra-lightweight polypropylene lid suitable for food products, wherein the lid has a central portion and a rim connected to the central portion, wherein the rim is adapted to mate with a bowl to form a closed food container, wherein the lid is prepared by injection molding using a polypropylene having about 15 to about 25 molar percent polyethylene and a melt index of about to about 50 g/10 min, wherein the central portion thickness of the lid is less than about 0.022 inches, and wherein the lid has sufficient impact resistance at −10F. to allow use for refrigerated and/or frozen food product.

11. The ultra-lightweight polypropylene lid of claim 10, wherein the polypropylene contains about 17 to about 19 molar percent polyethylene and has a melt index of about 30 to about 40 g/10 min. and wherein the central portion thickness of the lid is about 0.014 to about 0.020 inches.

12. The ultra-lightweight polypropylene lid of claim 11, wherein the polypropylene contains about 17.7 molar percent polyethylene has a melt flow index of about 35 g/10 min. and wherein the central portion thickness of the lid is about 0.014 to about 0.020 inches.

13. The ultra-lightweight polypropylene lid of claim 10, wherein the lid is used as an overcap for a container.

14. The ultra-lightweight polypropylene lid of claim 11, wherein the lid is used as an overcap for a container.

15. The ultra-lightweight polypropylene lid of claim 12, wherein the lid is used as an overcap for a container.

* * * * *

UNITED STATES PATENT AND TRADEMARK OFFICE

CERTIFICATE OF CORRECTION

PATENT NO. : 6,699,543 B1
DATED : March 2, 2004
INVENTOR(S) : Agarwal

It is certified that error appears in the above-identified patent and that said Letters Patent is hereby corrected as shown below:

Column 5,
Line 26, change “product” to -- products --.

Column 6,
Lines 2 and 32, change “product” to -- products --.
Line 40, after “melt” delete “flow”.

Signed and Sealed this

Sixth Day of July, 2004

JON W. DUDAS
*Acting Director of the United States Patent and Trademark Office*